United States Patent [19]

Lin

[11] 4,298,923

[45] Nov. 3, 1981

[54] ASSEMBLED FUSE LAMPHOLDER OF LIGHT SET

[76] Inventor: Shong D. Lin, No. 42, Chu-Wei Tsi, Ho-Ping Rd., Hsin-Chu City, Taiwan

[21] Appl. No.: 63,097

[22] Filed: Aug. 2, 1979

[51] Int. Cl.[3] ..... F21P 1/02

[52] U.S. Cl. ..... 362/392; 362/249; 362/252; 362/806; 339/176 L; 315/185 S

[58] Field of Search ..... 362/392, 806, 249, 252; 315/185 S; 339/176 L

[56] References Cited

U.S. PATENT DOCUMENTS 3,968,398 7/1976 Lehmann ..... 362/806

*Primary Examiner*—Stephen J. Lechert, Jr.

*Attorney, Agent, or Firm*—Cushman, Darby & Cushman

[57] ABSTRACT

The present invention is related to an assembled fuse lampholder of light set which consists of a fuse seat, a cylindrical sleeve and a plastic lampholder (soft head) and is characterized by achieving the protection of bulb and circuit thereof through the protective device of over current formed by the fuse seat and by putting it into practice in a very easy, convenient and safe manner.

3 Claims, 3 Drawing Figures

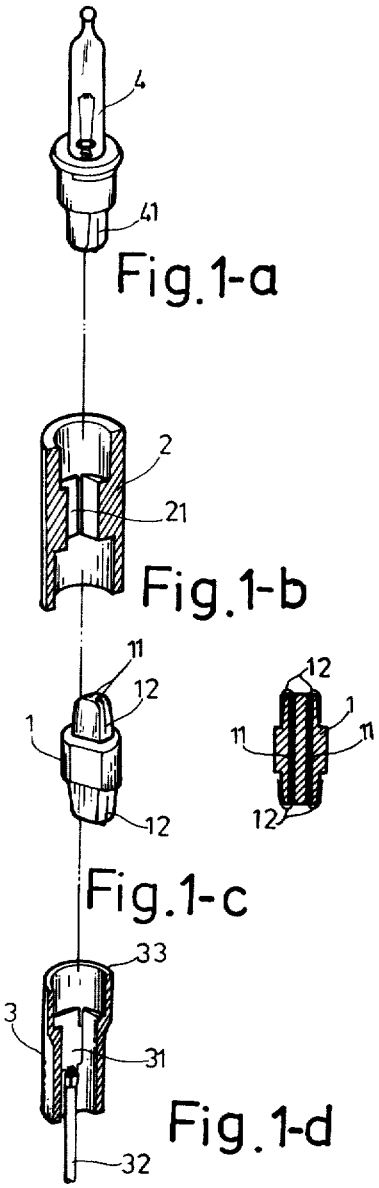
Fig.1-a
Fig.1-b
Fig.1-c
Fig.1-d
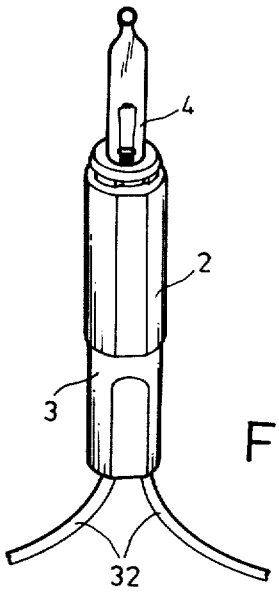
Fig. 2
Fig.1-e
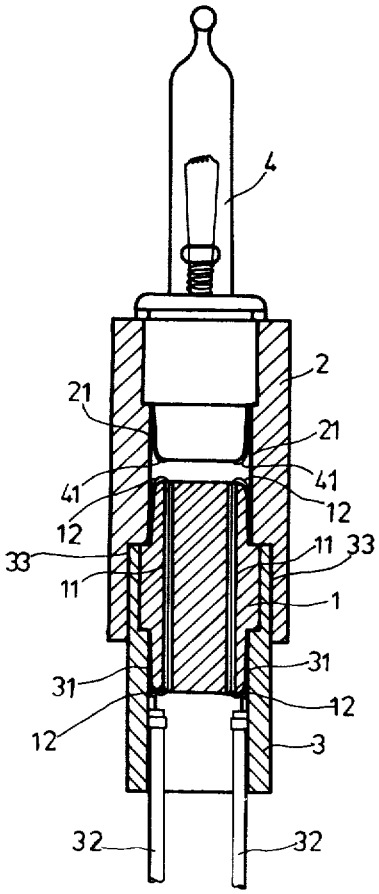
Fig. 3

ASSEMBLED FUSE LAMPHOLDER OF LIGHT SET

BACKGROUND OF THE INVENTION

In recent years, it is a fashion for more and more people to use the series small-size decorative bulbs for ornamenting and beautifying the surroundings day after day. However, it is frequently heralded that the explosion of bulb because of over current burning out the filament leads to current leakage, short circuit or even anti-personnel accident. Therefore, the bulbs manufactures have to try various ways and means for improving such drawbacks. The present invention can achieve the objective of eliminating said drawbacks through a protective device of over current formed by the fuse seat.

BRIEF DESCRIPTION OF THE DRAWINGS

1. Figures:

FIG. 1-a shows the bulb of the present invention.

FIG. 1-b shows the cylindrical sleeve of the present invention.

FIG. 1-c shows the fuse seat of the present invention.

FIG. 1-d shows the lampholder of the present invention.

FIG. 1-e is a section view of fuse seat of the present invention.

FIG. 2 is a dimensional assembly view of the present invention.

FIG. 3 is a assembly section view of the present invention.

2. Reference numbers: (1) Fuse seat (12) Fuse (21) Cylindrical sleave conductivity plate (3) Lampholder (32) Lampholder conductivity plate lead (33) Outer lampholder edge (41) Filament lead (11) Fuse setting passage (2) Cylindrical sleeve (31) Lampholder conductivity plate (4) Bulb

DESCRIPTION OF THE PREFERRED EMBODIMENT

The structure and functions of the present invention are best described in reference to the drawings as follows:

The fuse seat(1) of the present invention is made of fine insulating materials and designed to assemble the cylindrical sleeve(2) and lampholder(3) and to form a portion of circuit and a protective device of over current through the two parallel but not overlapped passages(11)(11') in the said seat for accommodating the fuse(12)(12').

The function of cylindrical sleeve(2) is to assemble the fuse seat(1) and lampholder(3) and to fix the bulb(4). The design and manufacture of inner shape of said sleeve depend on the outer shapes of bulb(4) and fuse seat(1) so that the bulb(4) and fuse seat(1) can be easily set in their right positions. In the cylindrical sleeve, thereare two-piece conductivity plates(21)(21') which can be connected with the filament lead(41) and fuse(12) so as to form a complete circuit and to maintain a fine contact among them.

In the lampholder(3), there are two conductivity plates(31) and a lead(32) connecting with the outer circuit. In addition, the interior of lampholder(3) can be used to accommodate the seat(1). The outer lampholder(33) edge is assembled with the cylindrical sleeve(2) so as to constitute a complete assembled fuse lampholder of light set.

SUMMARY OF THE INVENTION

In addition to the above-said functions, the present creation is further characterized by the following aspects:

1. It is easy to assemble and use but without danger.
2. It is easy to replace the fuse after the fuse is burnt out.
3. There are two fuses in the same one circuit so as to enhance its safety.
4. The bulb thereof will never explode.
5. It is particularly fit for the small-size bulb which is similar to the X'mas bulbs.

I claim:

1. A holder for a decorative light bulb comprising:

a cylindrical sleeve for receiving said bulb at one end thereof;

a fuse seat mounted within said sleeve and having first and second electrical fuse conduction paths therethrough connecting to said bulb when received in said sleeve; and a base extending into the other end of said sleeve for mounting electrical connections to electrically connect to said conduction paths so that current is supplied to said bulb via said conduction paths.

2. A holder as in claim 1 wherein said sleeve includes first and second plates for connecting respectively to one end of said first and second fuse paths, and wherein said base includes first and second plates for connecting respectively to the other end of said first and second fuse paths.

3. A holder as in claim 1 or 2 further including said bulb.

* * * * *